US005759928A

United States Patent [19]

Harper

[11] Patent Number: 5,759,928

[45] Date of Patent: Jun. 2, 1998

[54] RETROREFLECTIVE ARTICLE WITH NON-CONTINUOUS TOP COAT

[75] Inventor: James H. C. Harper, Hudson, Wis.

[73] Assignee: Minneota Mining and Manufacturing Company, St. Paul, Minn.

[21] Appl. No.: 804,852

[22] Filed: Feb. 24, 1997

Related U.S. Application Data

[63] Continuation of Ser. No. 563,512, Nov. 28, 1995, abandoned, which is a continuation of Ser. No. 247,017, May 20, 1994, abandoned.

[51] Int. Cl.[6] ..... E01F 9/04; B32B 27/18

[52] U.S. Cl. ..... 442/337; 428/325; 428/913; 428/195; 428/220; 428/105; 428/114

[58] Field of Search ..... 428/237, 325, 428/913, 195, 220, 105, 114

[56] References Cited

U.S. PATENT DOCUMENTS

| | | | |
|---|---|---|---|
| 3,935,365 | 1/1976 | Eigenmann | 428/323 |
| 4,020,211 | 4/1977 | Eigenmann | 428/323 |
| 4,117,192 | 9/1978 | Jorgensen | 428/337 |
| 4,248,932 | 2/1981 | Tung et al. | 428/325 |
| 4,377,530 | 3/1983 | Trenbeath et al. | 260/453 P |
| 4,379,767 | 4/1983 | Alexanian et al. | 260/453 P |
| 4,490,432 | 12/1984 | Jordan | 428/220 |
| 4,564,556 | 1/1986 | Lange | 428/325 |
| 4,758,469 | 7/1988 | Lange | 428/325 |
| 4,937,127 | 6/1990 | Haenggi et al. | 428/148 |
| 4,988,555 | 1/1991 | Hedblom | 428/172 |
| 5,069,964 | 12/1991 | Tolliver et al. | 428/325 |
| 5,077,117 | 12/1991 | Harper et al. | 428/143 |

FOREIGN PATENT DOCUMENTS 0 488 526 A1 6/1992 European Pat. Off. .

*Primary Examiner*—Kathleen Choi
*Attorney, Agent, or Firm*—Robert H. Jordan

[57] ABSTRACT

A pavement marking material comprises a flexible base sheet that is conformable to an irregular pavement surface. A non-continuous, durable, wear-resistant polymeric top layer is adhered to one surface of the base sheet. The discontinuous nature of the polymeric top layer provides for increased initial conformance of the pavement marking to irregular pavement surfaces. The discontinuous nature of the polymeric top layer also reduces elastic tensile stresses which tend to build up in continuous top layers and cause adhesive failure. A plurality of particles, retroreflective microspheres and/or skid-resistant particles, are embedded in and protrude from the non-continuous top layer.

17 Claims, 4 Drawing Sheets

RETROREFLECTIVE ARTICLE WITH NON-CONTINUOUS TOP COAT

This application is a continuation of U.S. application Ser. No. 08/563,512, filed Nov. 28, 1995, now abandoned, which was a continuation of U.S. application Ser. No. 08/247,017, filed May 20, 1994, now abandoned.

FIELD OF INVENTION

The present invention relates to an improved pavement marking material which may be adhered to a roadway to provide traffic control markings and the like and a method for making such pavement marking material.

BACKGROUND

Pavement markings are important in order to provide visual guidance to motor vehicle drivers. Preformed pavement marking materials are used as traffic control markings for a variety of uses, such as short distance lane striping, stop bars, and pedestrian pavement markings at intersections. Typically, preformed pavement marking materials comprise a continuous, wear-resistant top layer overlying a flexible base sheet. Such materials are applied to substrates using pressure sensitive adhesive or contact cement.

For example, U.S. Pat. No. 4,020,211 discloses a preformed marking composite material comprising a continuous polyurethane top layer adhered to a flexible base sheet. These marking materials have a very high Young's modulus, well above 300,000 psi (2100 MPa). As a result, while these materials are very wear-resistant, these materials are so stiff and non-conformable that the entire composite material tends to come loose from irregular pavement surfaces due to poor adhesion to the pavement.

A more conformable preformed pavement marking material comprising a more elastic, continuous polyurethane wear layer adhered to a flexible base sheet is described in U.S. Pat. Nos. 4,248,932; 4,117,192; and 3,935,365. These materials have better initial conformance to irregular pavement surfaces due to the lower modulus of the polyurethane wear layer. The elastic nature of the polyurethane wear layer, though, produces elastic tensile stresses in the top layer as these marking materials are adhered and conformed to the pavement. Over time, these stresses tend to cause adhesive failure, after which the marking materials would come loose from the pavement.

U.S. Pat. No. 4,988,555 (Hedblom) describes a pavement marking material comprising a polyurethane bead bond overlying a flexible base sheet having protrusions on one surface. The bead bond covers selected portions of these protrusions.

U.S. Pat. No. 5,077,117 (Harper, et.al.) describes a pavement marking material with a flexible base sheet that is conformable to an irregular pavement surface. The wear-resistant polymeric top coat is applied to one surface of the base sheet as a continuous coating. The top layer is capable of undergoing brittle fracture at a temperature from 0° C. to 45° C. such that when the base sheet conforms to an irregular surface, the top layer readily ruptures to relieve stress build-up in the top layer as the regions of the top layer defined by the ruptures remain adhered to, and follow the conformance of the base sheet.

What is needed is a pavement marking with the excellent durability characteristics of a tough wear-resistant, hard top layer, and the flexibility characteristics of a conformable base sheet, that will adhere well to irregular pavement surfaces while maintaining or increasing the reflectivity and skid-resistance of the pavement markings currently available.

SUMMARY

The present invention provides an improved pavement marking material which comprises a non-continuous, or segmented, wear-resistant top layer that can be conformed to irregular pavement surfaces without developing the elastic stresses that can lead to adhesive failure. Preferred pavement marking materials have the excellent durability characteristics of a tough, wear-resistant, hard top layer, while retaining the flexibility of an underlying conformance layer. As a result of these properties, the pavement marking materials of the present invention are long-lived and easily applied to a pavement having a rough or irregular surface. In addition to the excellent durability achieved herein, pavement markings of the invention can provide good retroreflective performance from a wide zone of approach, making them well-suited for areas where traffic approaches from many directions, e.g., intersections.

In brief summary, the invention provides a pavement marking material comprising a flexible base sheet that is conformable to an irregular pavement surface and a durable, wear-resistant non-continuous polymeric top layer. The polymeric top layer comprises a plurality of segments adhered to one surface of the base sheet. The distance between the areas of the segments in contact with the base sheet is at least 1.5 millimeters (mm), and typically less than 20 mm, preferably less than 6 mm. A plurality of particles are partially embedded in and protrude from the polymeric top layer. The particles may include reflective microspheres and skid-resistant particles.

The discontinuous nature of the polymeric top layer reduces elastic tensile stresses which tend to build up in a continuous top layer. The contrast introduced by a non-continuous top layer provides for improved skid-resistance over a continuous top layer. Reflectivity of the pavement marking may also be increased over a continuous top layer by selecting the distance between segments of the topcoat.

Pavement marking materials of the invention have greater conformability than can be achieved with a pavement marking material having a more elastic, continuous top layer. Practical tests have shown that preferred pavement marking materials are more lastingly adhered to irregular pavement surfaces than previously known materials. Further, the present invention shows retained reflectivity and whiteness values as good or better than those values showed by the previously known materials with continous top layers.

The preferred materials also exhibit excellent durability. In a test using a Model No. 503 Standard Abrasion Tester, Taber Abraser, Teledyne Tabor, North Tonawonda, N.Y., which was fitted with an H-22 abrader wheel and a one kilogram weight, the preferred materials showed a weight loss of from about 0.05 grams to about 0.30 grams over 1000 cycles.

Reflective and skid-resistant particles are applied only to the non-continuous top layer. Because there is typically less surface area with a non-continuous top layer to apply particles to, the construction of the pavement marking of the invention may require fewer particles and may therefore be less expensive than a comparably constructed pavement marking with a continuous top layer.

The novel structure of pavement markings of the invention can impart greater durability, greater conformability, increased retroreflectivity, and increased skid-resistance as compared to a pavement marking made with the same materials applied in a continuous top layer.

BRIEF DESCRIPTION OF DRAWINGS

The invention will be further explained with reference to the drawings, wherein.

These figures, which are idealized, are not to scale and are intended to be merely illustrative and non-limiting.

DETAILED DESCRIPTION OF ILLUSTRATIVE EMBODIMENTS

As mentioned above, the invention provides a pavement marking material comprising a flexible base sheet that is conformable to an irregular pavement surface and a durable, wear-resistant non-continuous polymeric top layer. The polymeric top layer comprises a plurality of segments adhered to one surface of the base sheet. The distance between the areas of the segments in contact with the base sheet is at least 1.5 millimeters. A plurality of particles are partially embedded in and protrude from the polymeric top layer. The particles include reflective microspheres and skid-resistant particles.

Figure 2:
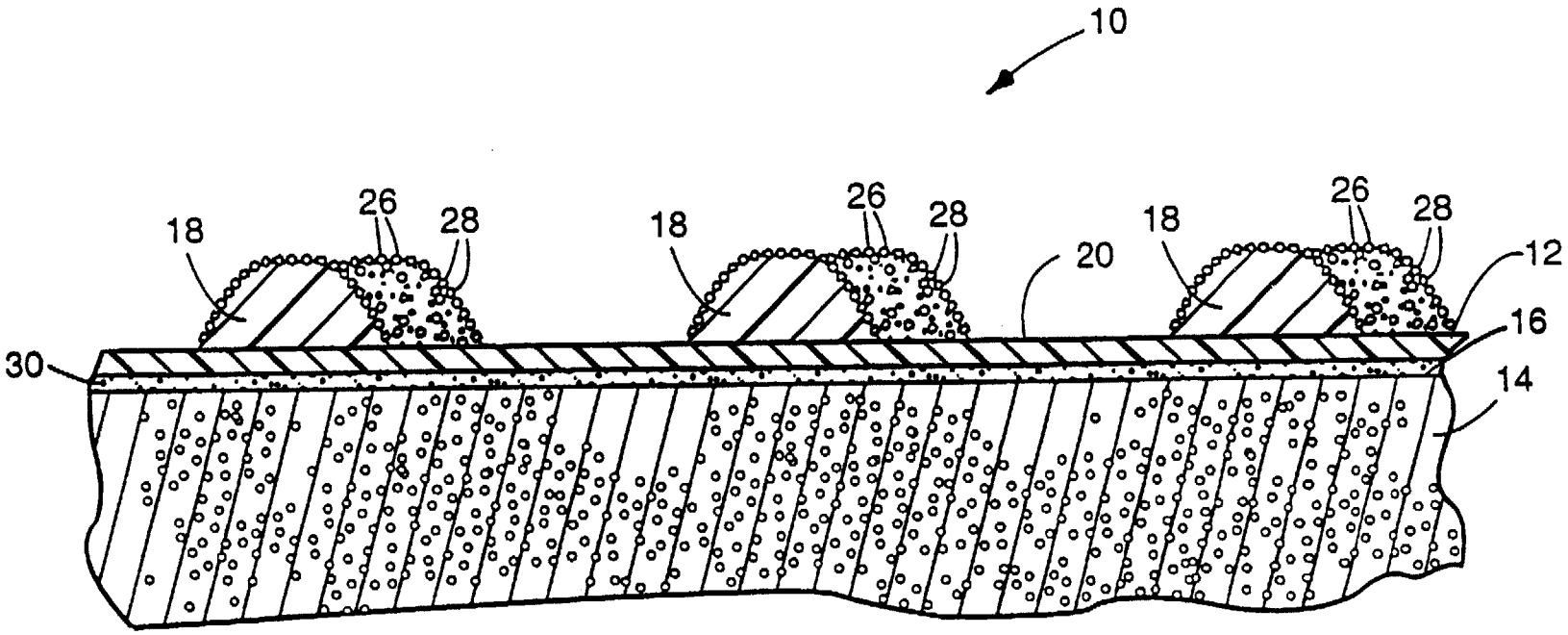
FIG. 2 is a cross-sectional view of a preferred embodiment of the invention.

Referring now to FIG. 2, there is shown a preferred embodiment of a pavement marking material 10 according to the present invention. The pavement marking material 10 comprises a flexible base sheet 12 that is conformable to an irregular pavement surface 16.

The pavement marking material 10 has greater conformability than can be achieved with a pavement marking material having a more elastic top layer that is continuous. When a more elastic top layer is deformed in order to conform to an irregular or rough pavement surface, elastic stresses develop in the top layer. These stresses tend to pull back against the adhesive used to hold the pavement marking material to the pavement. Over time, these forces tend to cause the adhesive to fail, after which the pavement marking material would come loose from the pavement.

In the present invention, however, the energy of such elastic stresses does not build up in the non-continuous top layer. Instead, as the top layer 18 conforms to the pavement 14, the large areas of uncoated base layer 20 prevent the build up of such stresses. Thus, the elastic stresses that can cause the pavement marking material 10 to come loose from the pavement 14 are greatly reduced or eliminated. As a result, the present invention has improved long-term adhesion to pavements having rough or irregular surfaces.

Preferably, the base sheet 12 is substantially flat and has substantially no protrusions. Examples of suitable base sheets are the reduced-elasticity sheets disclosed in U.S. Pat. Nos. 4,117,192 and 4,490,432. Such reduced-elasticity base sheets comprise unvulcanized elastomer precursors, extender resins such as chlorinated paraffin, fillers, and non-woven webs such as those made from spun-bonded polyolefins or polyesters.

The base sheet 12 is typically from about 500 micrometers (μm) to about 1300 μm thick to provide desired conformability and strength to the substrate marking material. Most preferably, the base sheet 12 is about 900 μm thick. Below about 500 μm, the base sheet 12 may not provide sufficient strength or support for the pavement marking material 10. Above about 1300 μm, the marking material 10 may stick up too far from the pavement 14 such that snow plows may damage or dislodge the marking material 10.

Optionally, pigments may be added to the base sheet 12 for coloration. Titanium dioxide will impart a white color to the base sheet 12. Another useful pigment is lead chromate, which imparts a yellow color to the base sheet 12. Particulate fillers may also be included in the base sheet 12, typically in large amounts, to lower cost and to provide modified properties, such as reinforcement, extending, surface hardness, and abrasion resistance.

Figure 3:
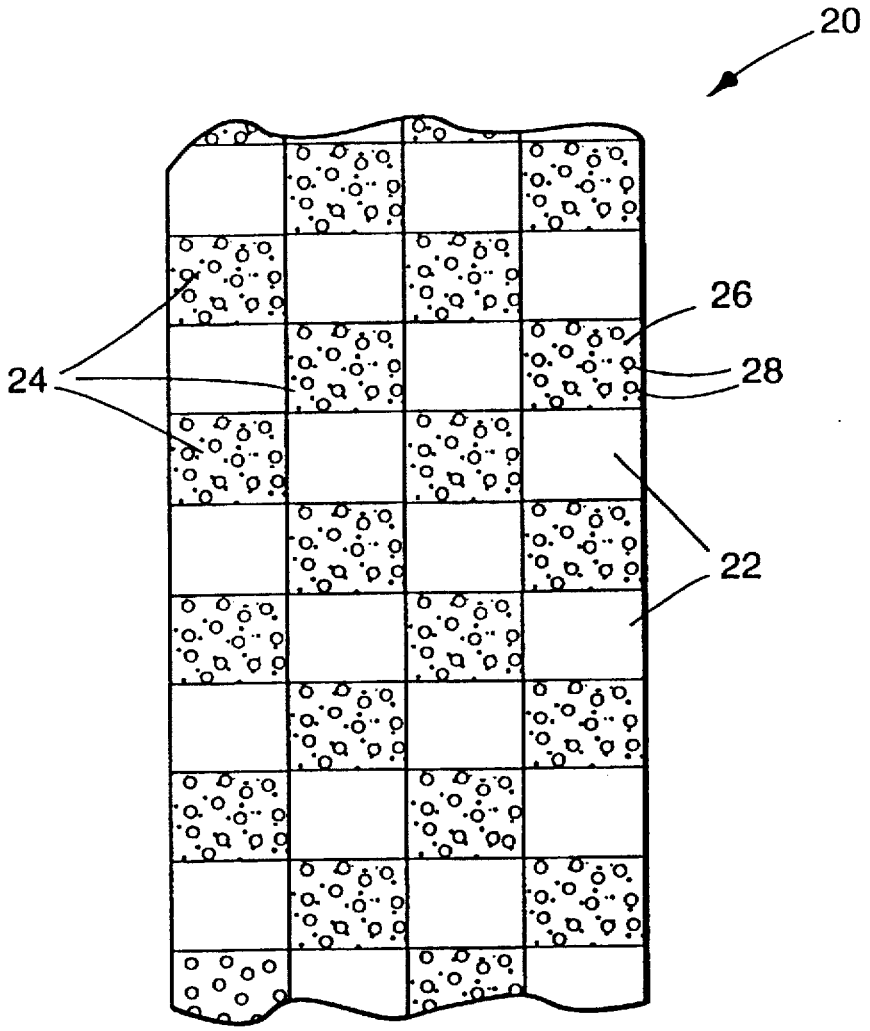
FIG. 3 is a schematic diagram of an embodiment of the invention, demonstrating the non-continuous nature of the top layer.

A durable, wear-resistant, non-continuous polymeric top layer 18 is applied to one surface of the base sheet 12. Various patterns for the non-continuous top layer will be suitable to provide the desired characteristics of wear resistance and conformability of the pavement marking material. Other important properties to be considered in selecting a pattern for the non-continuous top layer include low stress concentration, low dirt retention, high reflectivity, and high skid resistance. FIG. 3 depicts an example of an illustrative embodiment of the invention wherein the discontinuous top layer is in a checkerboard pattern.

Skid resistance is believed to be increased by the contrast between the uncoated areas of flexible base sheet and segments of polymeric top layer with embedded skid-resistant particles. Likewise, the configuration and height of the segments of the top layer, as well as the spacing between segments, may be selected to maximize retroreflectivity by minimizing shadowing. Shadowing refers to the vertical aspect of a raised element blocking, or shadowing, nearby raised elements such that the retroreflective microspheres on the sides of the shadowed raised elements are not visible and thus are not utilized.

Also, the raised element nature of the segments of the non-continuous top layer increases reflectivity under wet conditions compared to a pavement marking with a continuous top layer. This is because the water will run off the raised elements and not pool over the reflective microspheres.

Preferably, the top layer 18 has a Young's modulus of from 50,000 psi (350 MPa) to 300,000 psi (2100 MPa), and more preferably from 100,000 psi (700 MPa) to 300,000 psi (2100 MPa). If the modulus is too low, the top layer 18 may not have sufficient wear and abrasion resistance properties. If the modulus is too high, then the top layer 18 may not have sufficient conformability characteristics.

When testing a material for tensile properties, the following test procedure was used: The polyurethane was cast onto a coated paper liner and cured in an oven for 10 to 15 minutes at a temperature from 120° C. to 135° C. After cooling, the polyurethane was removed from the paper liner and cut into 0.5 inch (1.3 cm) by 6 inch (15.2 cm) strips. These strips were preconditioned at 72° F. (22.2° C.) and 50% relative humidity for 48 hours. They were then secured in the jaws of an Instron Universal Testing Instrument, Instron Corporation, Canton, Mass., set 4 inches (10.2 cm) apart. The jaws were then driven apart at 10 inches per minute (25.4 cm/min) until the sample broke. The force required to effect this separation was plotted and recorded. The elastic modulus (Young's modulus) was determined based upon the ratio of force required in straining the sample to 1% strain divided by the cross sectional area of the sample.

Referring again to FIG. 2, suitable polymeric materials for the top layer 18 include polyurethanes, epoxy resins, polyamides, polyureas, and polyesters. Mixtures of such materials would also be suitable in the present invention. Thermosetting polymers are preferred for the top layer because top layers formed of such materials typically will not deform under extreme temperature and pressure conditions, and thus will last longer.

Preferably, the top layer 18 comprises a polyurethane. Polyurethanes generally are characterized by excellent adhesion to particles 26 and 28 which are subsequently embedded in the top layer 18. Preferred polyurethanes are aliphatic polyurethanes. Aliphatic polyurethanes strongly adhere to the base sheet 12, are highly cohesive, and are resistant to environmental weathering.

One illustrative example of a polyurethane suitable for use in the present invention is derived from a polyol component and a polyisocyanate, wherein the equivalent ratio of NCO groups of the polyisocyanate to the OH groups of the polyol component is from about 0.5 to about 1.5, and preferably about 1.05. The polyol component may be a mixture of any low molecular weight polyols and/or polymeric polyols.

Preferably, the polyol component comprises one or more polyols having an average molecular weight of from about 300 to about 660, an average equivalent weight of from about 100 to about 220, and an average of about 3 or more hydroxyl groups per polyol. More preferably, the polyol component comprises about one equivalent of a polycaprolactone triol having a hydroxyl equivalent weight of about 100, and from 0 to 0.33 equivalents of a polycaprolactone triol having a hydroxyl equivalent weight of about 300.

The polyisocyanate is preferably an aliphatic compound, since such compounds show less discoloration than aromatic compounds during outdoor weathering. Polyisocyanate compounds which have aromatic rings which are not bonded directly to the isocyanate groups, but rather are bonded to a hydrogen-free carbon atom, are also useful. Compounds of this type are disclosed in U.S. Pat. Nos. 4,377,530 and 4,379,767.

Illustrative examples of useful polyisocyanates include isophorone diisocyanate; 4,4'-methylene-bis-cyclohexyl diisocyanate tetramethylene diisocyanate; 1,3 and 1,4 cyclohexyl diisocyanate; 1,6 hexamethylene diisocyanate; adducts of 1,6 hexamethylene diisocyanate; isomers of tetramethylxylylene diisocyanate; or isocyanate terminated polymers derived from polyols and difunctional aliphatic isocyanates.

In a particularly preferred polyurethane, the polyol component comprises about 100 parts by weight of a polycaprolactone triol having a molecular weight of about 300, such as Tone 0301 available from Union Carbide Company. The polyol component also comprises from 0 to 100 parts by weight, preferably from 10 to 25 parts by weight, and more preferably about 19 parts by weight, of a polycaprolactone triol having a molecular weight of about 960, such as Tone 0310 available from Union Carbide Company. The lower molecular weight triol imparts rigidity to the polyurethane, whereas the higher molecular weight triol is used to lower the modulus of the polyurethane. If too much of the higher molecular weight triol is used, however, the polyurethane will not have sufficient wear-resistance.

The particularly preferred polyurethane also comprises from about 190 to about 230 parts by weight, and preferably about 210 parts by weight, of a biuret adduct of 1,6 hexamethylene diisocyanate, such as Desmodur N-100 available from Mobay Chemical Division of U.S. Bayer. For the particularly preferred polyurethane, the equivalent ratio of NCO groups of the polyisocyanate to the OH groups of the polyol component is about 1.05.

The top layer 18 may also comprise a variety of inorganic additives such as inert fillers, extenders, and pigments as are used in known pavement marking materials. The various inorganic additives may be treated with a coupling agent such as a silane coupling agent to improve bonding to polyurethane polymers. Inert fillers include alumina; magnesium silicate; magnesium oxide; calcium carbonate; calcium meta silicates; amorphous or crystalline silica; zinc oxide; lead chromate; and zirconium oxide.

Pigments or other coloring agents may be included in the top layer 18 in an amount sufficient to color the marking material for a particular use. For example, when used as a pavement marking material, titanium dioxide is a desired pigment and filler to provide a white color and to provide a diffuse reflective background for retroreflective microspheres 26 subsequently embedded in the top layer 18, whereas, lead chromate will typically be used to provide a yellow color.

Other pigments including reflective pigments having a large specular component such as aluminum flakes or nacreous pigment flakes, may also be used in the top layer. The specularly reflective pigments will be particularly useful on the sides of the segments of the non-continuous top layer due to the vertical component. It is important that the polymer selected for the top layer be light-transmissive, so that light striking the reflective pigments will not be absorbed but will instead be retroreflected so as to be of use to a motor vehicle driver.

The top layer 18 is at least from about 100 micrometers (μm) to about 2000 μm thick. Preferably, the top layer 18 is from about 500 to about 1500 μm thick, and most preferably about 1250 μm thick. If the top layer 18 is not thick enough, the top layer 18 may not provide sufficient bonding to particles subsequently embedded in the top layer, nor sufficient wear resistance or vertical surface for retroreflectivity. If the top layer 18 is too thick, the overall structure may be too rigid to achieve desired conformance characteristics.

The top layer 18 is preferably a branched, cross-linked polymer network. Cross-linking is believed to contribute to the wear-resistance of the pavement marking material 10. It has also been found that as the polymeric top layer 18 is more highly cross-linked, the top layer shows better resistance to discoloration from tires that travel over the marking, or from other oil, dirt, or grime the may come into contact with the pavement marking material 10.

A plurality of particles 26 and 28 are embedded in and protrude from the segments of the non-continuous top layer 18. The particles are embedded in and protrude from all exposed surfaces of the segments, that is, from the sides of the segments as well as the tops of the segments. The particles 26 and 28 comprise retroreflective microspheres 26 and skid-resistant granules 28. The particles 26 and 28 may be applied to the still-liquid top layer 18 by a flood coating process which results in a dense packing of particles 26 and 28 in the top layer 18. Alternatively, the particles 26 and 28 may be sprinkled or cascaded onto the top layer 18 such that a dense packing of particles 26 and 28 is avoided. The sprinkling process is particularly advantageous to minimize particle useage, to decrease dirt retention between particles, and to optimize retroreflection.

Retroreflective microspheres 26 suitable for use in the present invention include glass microspheres having an index of refraction of from about 1.5 to about 1.9. Glass microspheres having an index of refraction closer to about 1.5 are less costly and more scratch and chip resistant. However, glass microspheres having an index of refraction of from about 1.7 to about 1.9 are more effective retroreflectors.

Preferred retroreflective microspheres 26 are disclosed in U.S. Pat. Nos. 4,564,556 and 4,758,469. The preferred microspheres are described as solid, transparent, nonvitreous ceramic spheroids comprising at least one crystalline phase comprised of a metal oxide. These microspheres may also have an amorphous phase, such as an amorphous silica phase. The term nonvitreous means that the microspheres have not been derived from a melt or mixture of raw materials brought to the liquid state at high temperature. These microspheres are extremely resistant to scratching or chipping and can be made with an index of refraction of from about 1.4 to about 2.6. It is the combination of ceramic microspheres and thermosetting top layer that is critical to the longevity of embodiments of this invention. Preferred microspheres have an index of refraction of about 1.7 to about 2.0, although microspheres of other indices of refraction will also be suitable. Suitable microspheres have an average diameter of about 50 μm to about 600 μm, although larger microspheres will also be suitable. Preferred microspheres have an average diameter of about 200 μm to about 250 μm.

Skid-resistant granules 28 are used to provide a marking material having a residual skid resistance in the British Portable Skid Resistance test of at least 50 BPN. BPN means the British Portable Number as measured using a Portable Skid Resistance Tester built by Road Research Laboratory, Crawthorne, Berkshire, England. Suitable skid-resistant granules include white aluminum oxide granules. It has been found that a blend of fine aluminum oxide granules and larger aluminum oxide granules provides acceptable, long-lasting skid-resistance. A preferred skid-resistant granule is disclosed in U.S. Pat. No. 4,937,127. These granules are described as ceramic spheroids that are a fired ceramic comprising a mineral particulate, alumina, and a binder. These spheroids are extremely durable and impart excellent skid-resistant characteristics to pavement marking materials.

The particles 26 and 28 may be treated with a coupling agent that improves adhesion between the particles 26 and 28 and the top layer 18. Preferred agents are silane compounds, such as the aminosilane compounds. The particles may also be treated with a surface modifying agent to increase their surface energy in contact with the liquid phase of the top layer during curing, allowing the microspheres to protrude from this surface. Preferred surface modification agents are fluorocarbons. Alternatively, such agents may be included in the top layer 18 so that the agent interacts with the particles 26 and 28 when the particles 26 and 28 are embedded in the top layer 18.

The top layer 18 is generally formed by pattern coating liquid ingredients directly onto the base sheet 12, for example with a rotary screen die or a clam-shell die. The top layer 18, however, may be formed separately, and then bonded to the base sheet 12 in a laminating operation, as by interposing an adhesive layer (not shown in FIG. 2) between the top layer 18 and the base sheet 12.

Pattern coating using a die with chambers makes it possible to apply a segmented top layer which will appear one color when viewed from one direction, and another color when viewed from the other direction. One side of the segments will be one color, and the other side a different color. (see FIG. 4 wherein 41 denotes one side of the segment and 43 denotes the opposite side) Such a transverse pavement marking material would have particular utility anywhere the traffic flow is unidirectional. For example, a transverse stop bar at a freeway off-ramp would appear white to cars traveling off the ramp, but red to a car attempting to enter the highway on the off-ramp.

While the top layer is still fluid the particles are delivered into it. The particles are delivered by any suitable method, for example from a hopper. The delivery system is preferably equipped with a means to control the number of particles applied. A preferred particle application method is to drop the particles onto the web (the web being the flexible base sheet with the non-continuous polymeric top layer), and vibrate the web until substantially all the particles come into contact with the polymeric top layer and adhere to it.

One factor affecting the performance of the preferred pavement marking material 10 concerns the viscosity of the top layer 18 during the curing process. The viscosity of the particularly preferred polyurethane described above has a propensity to drop as the top layer 18 is heated for curing. If particles 26 and 28 are added to the top layer 18 during this low viscosity stage, the particles 26 and 28 could sink to the bottom of the top layer 18 where the effectiveness of the particles 26 and 28 would be decreased. To overcome this problem, the top layer 18 is preferably precured to increase the viscosity of the top layer 18 before the particles 26 and 28 are applied to the top layer 18. To accomplish this, the polyurethane top layer 18 is heated at about 150° C. for a time sufficient to adjust the viscosity of the top layer 18 such that the particles 26 and 28 sink into the top layer up to about one half of the average diameter of the particles.

An adhesive layer 30 may be carried on the bottom surface of the base sheet 12 for application to substrate 14. Alternatively, an adhesive layer 30 may be applied first to substrate 14 after which the substrate marking material 10 is adhered over the adhesive layer 30. A suitable adhesive can be readily selected by one skilled in the art. Pressure sensitive adhesives such as those disclosed in European Patent Application No. 91.309941.2 filed Oct. 28, 1991 are preferred. Contact adhesives may also be used. An advantage of the present invention is that a greater variety of adhesives can be used with pavement markings of the invention than can be used with pavement markings comprising continuous, relatively more elastic top layers.

Figure 1:
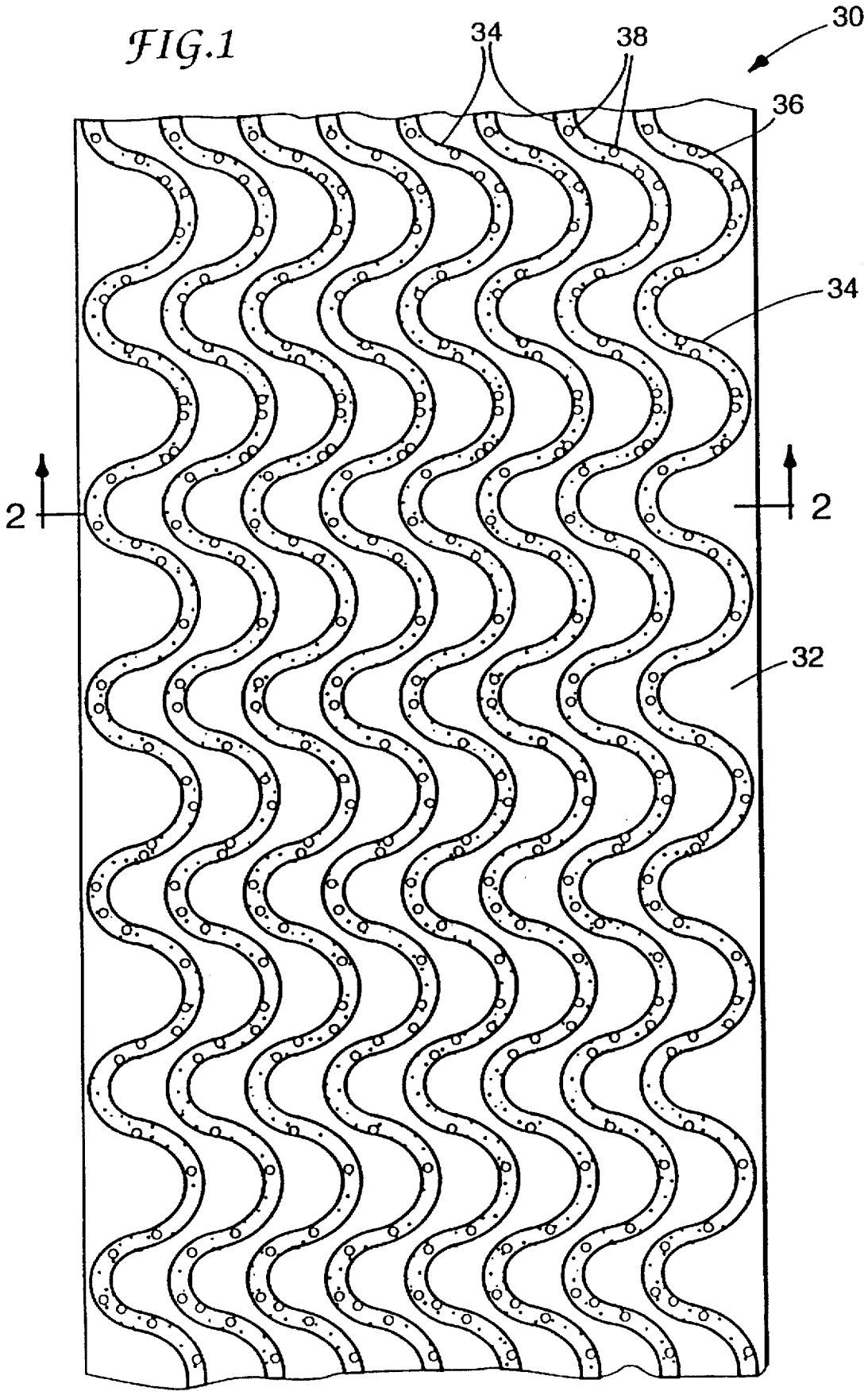
FIG. 1 is a schematic diagram of a preferred embodiment of the invention.

A preferred embodiment of the pavement marking of the invention is shown is FIG. 1. This embodiment is particularly preferred as resulting in an optimized combination of wear-resistance, conformability, low stress concentration, high reflectivity, and high skid-resistance. The preferred embodiment is a plurality of segments, with each segment in the shape of a wavy stripe. The segments are approximately 4 to 6 millimeters (mm) wide, and approximately 1.3 mm high. The segments are spaced approximately 7 to 9 mm apart. The side to side amplitude of oscillating segments is approximately 25 mm. Reflective and skid-resistant particles are embedded into the top layer at a density of approximately 60 grams per square meter for the skid particles and about 135 grams per square meter for the microspheres. The reflective microspheres are ceramic, and have a refractive index of approximately 1.8. In FIG. 1 the pavement marking material is oriented with the wavy stripes running parallel to the direction of travel, such as the centerline or edgeline of a road. However, the pavement marking material in this embodiment could be oriented with the wavy stripes normal to the direction of travel, and it would still be visible and useful.

Figure 4:
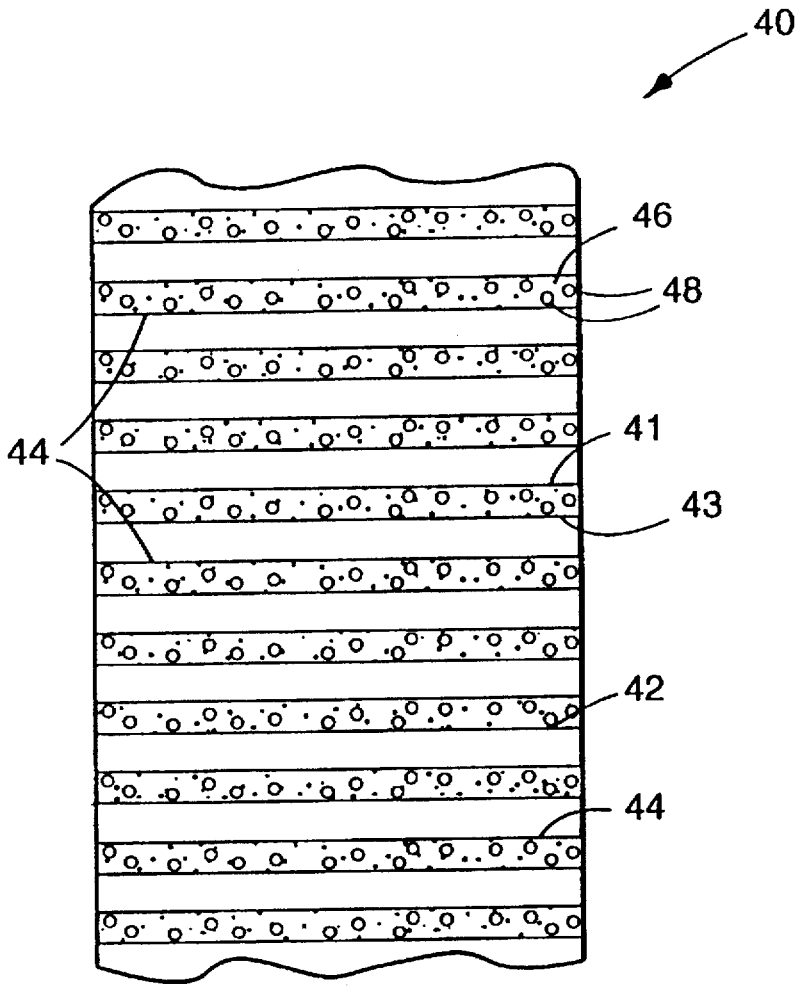
FIG. 4 is a schematic diagram of an embodiment of the invention, depicting crossweb bands.

FIG. 4 is a schematic diagram of another preferred embodiment of the invention. In this embodiment, the pavement marking is oriented so that the segments of the non-continuous top layer are normal to the direction of travel.

EXAMPLES

The invention will be further explained by the following illustrative examples which are intended to be non-limiting. Unless otherwise indicated, all amounts are expresses in parts by weight.

Example 1

A polyurethane coating was prepared as described in Example 1 of U.S. Pat. No. 5,077,117 and coated through a pattern coating die onto a 875 micrometers (μm) highly filled, calendared flexible acrylonitrile butadiene rubber base sheet. The pattern coating die consisted of a series of openings 0.32 centimeters (cm) wide separated by 0.96 cm. The polyurethane was coated through the die at a rate of 436 grams per square meter of base sheet. The die was oscillated as the base sheet moved below it, resulting in a sinusoidal pattern of polyurethane being coated on the base sheet. The side to side amplitude of the oscillation was set at 2.54 cm. (+/−1.27 cm. from the center point) The frequency of the oscillation was set to complete one cycle every 3 seconds. The base sheet was moving at 3 meters (m) per minute, resulting in a wavy line with a 15 cm. long repeating pattern. After being coated with polyurethane, the web entered an oven and was cured at 140° C. for 1 minute. Glass microspheres (600 micrometers, 1.5 index of refraction, treated with 3-amino propyl triethoxy silane commercially available as A1100 from Union Carbide Company and also treated with a fluorocarbon anti-wetting agent commercially available as Scotchban™ FC-805 from the 3M Company) and ceramic anti-skid particles (described in U.S. Pat. No. 4,937,127 and similarly treated with silane and fluorocarbon) were sprinkled over the surface of the coating. Cure of the polyurethane was completed at 150° C. for 3 minutes. The resultant pavement marking had a wavy line pattern in the top layer in which the dimensions of the lines were approxiamtely 0.12 cm high and 0.63 cm wide. The distance between lines was approximately 0.63 cm. The lines making up the top layer created an oscillating pattern with a side to side distance of about 2.54 cm. and a repeating pattern of 15 cm. Glass microspheres and ceramic anti-skid particles protruded from the surface of the top layer.

Example 2

A pavement marking tape construction was coated as described in Example 1 except that the pattern coating die was pressed against the coating as the base sheet moved under it, causing the top layer to be flattened so that the resultant wavy line pattern dimensions were approximately 0.09 cm high, 0.95 cm. wide, separated by a distance of about 0.32 cm.

Example 3

A pavement marking tape construction was coated as described in Example 1 except that the pattern coating die was oscillated at a rate of 1 cycle per second, resulting in a wavy line pattern in which the length of the oscillating pattern repeated every 5.1 cm.

Each of the three examples were applied to an intersection substrate using a pressure sensitive adhesive applied to the bottom of the base sheet. A similar construction with a continuous coating of the same polyurethane composition in the top layer was also installed. The initial conformance of the patterned pavement marking tapes were all judged to be better than the pavement marking tape with the continuous top layer. Examples 1 and 3 were also better for conformance than Example 2. After being exposed to traffic for over 8 months, the pavement markings with the patterned coatings were still adhered to the road surface while the pavement marking with the continuous top layer was partially loosened from the action of traffic. Example 3 had the best adhesion to the road, followed by Example 1 and then Example 2, with the basis for this observation being 8 months on a confidential test deck in New Orleans. Retention of reflectivity was essentially equal for all the patterned samples and was approximately 40 percent higher than for the continuously coated control, with the basis for this observation being 9 months on a confidential test deck in St. Paul, Minn.

Various modifications and alterations of this invention will become apparent to those skilled in the art without departing from the scope and spirit of this invention.

What is claimed is:

1. A pavement marking material, comprising a) a flexible base sheet that is conformable to an irregular pavement surface, said base sheet being substantially flat and having substantially no protrusions;

b) a discontinuous wear-resistant polymeric layer adhered to one surface of the base sheet, said polymeric layer comprising a different polymeric material than that of the base sheet and being less conformable than said base sheet, said polymeric layer having a Young's modulus of from 50,000 psi to 300,000 psi and being made up of a plurality of segments adhered to one surface of the base sheet such that portions of said segments are in contact with said base sheet with said portions being separated from one another by a distance of at least about 1.5 millimeters; and c) a plurality of particles embedded in and protruding from said discontinuous polymeric layer.

2. A pavement marking material, comprising a) a flexible base sheet that is conformable to an irregular pavement surface, said base sheet being substantially flat and having substantially no protrusions;

b) a discontinuous wear-resistant polymeric layer adhered to one surface of the base sheet, said polymeric layer having a Young's modulus of from 50,000 psi to 300,000 psi and being made up of a plurality of segments adhered to one surface of the base sheet such that portions of said segments are in contact with said base sheet with said portions being separated from one another by a distance of at least about 1.5 millimeters; wherein said discontinuous polymeric layer is applied in a selected oscillating stripe pattern; and c) a plurality of particles embedded in and protruding from said discontinuous polymeric layer.

3. A pavement marking material, comprising a) a flexible base sheet that is conformable to an irregular pavement surface, said base sheet being substantially flat and having substantially no protrusions;

b) a discontinuous wear-resistant polymeric layer adhered to one surface of the base sheet, said polymeric layer having a Young's modulus of from 50,000 psi to 300,000 psi and being made up of a plurality of segments adhered to one surface of the base sheet such that portions of said segments are in contact with said base sheet with said portions being separated from one another by a distance of at least about 1.5 millimeters; wherein said segments are generally parallel and in the form of a sinusoidal wave having amplitude A and wave length L; and c) a plurality of particles embedded in and protruding from said discontinuous polymeric layer.

4. The article of claim 1 wherein said flexible base sheet is a polymeric material.

5. The article of claim 1 wherein said discontinuous polymeric layer comprises a thermosetting polymer.

6. The article of claim 1 wherein said discontinuous polymeric layer is applied in a selected pattern.

7. The article of claim 1 wherein said segments are generally parallel.

8. The article of claim 1 wherein said particles are selected from the group consisting of retroreflective microspheres and anti-skid particles.

9. The article of claim 5 wherein said thermosetting polymer is selected from the group consisting of polyurethane, epoxy resin, polyamide, polyurea, polyester, and mixtures of such polymers.

10. The article of claim 6 wherein said flexible base sheet has a longitudinal axis, said discontinuous polymeric layer applied in segments perpendicular to said longitudinal axis, and said segments are less than 20 millimeters apart.

11. The article of claim 1 wherein one side of said segments is a first color and the other side of said segments is a second color.

12. The article of claim 3 wherein said segments have a height of about 1.3 millimeters.

13. The article of claim 3 wherein said stripes are spaced a distance of less than 7 millimeters apart.

14. The article of claim 3 wherein the ratio of A to L of said sinusoidal wave is about 1 to 2.

15. The article of claim 1 wherein said segments are up to approximately 9.5 millimeters wide.

16. The article of claim 1 wherein said segments are approximately 4 to 6 millimeters wide.

17. The article of claim 1 wherein said particles protrude from the sides as well as the tops of said segments.

* * * * *